United States Patent [19]

Allan et al.

[11] Patent Number: 4,816,136

[45] Date of Patent: Mar. 28, 1989

[54] LOW SEVERITY FLUID COKING

[75] Inventors: David E. Allan, Epsom, England; Don E. Blaser, Tulsa, Okla.

[73] Assignee: Exxon Research and Engineering Company, Florham Park, N.J.

[21] Appl. No.: 15,438

[22] Filed: Feb. 17, 1987

Related U.S. Application Data

[63] Continuation-in-part of Ser. No. 866,744, May 27, 1986, abandoned, which is a continuation-in-part of Ser. No. 763,208, Aug. 7, 1985, abandoned, which is a continuation-in-part of Ser. No. 619,542, Jun. 11, 1984, abandoned.

[51] Int. Cl.[4] ..... C10G 9/32

[52] U.S. Cl. ..... 208/127; 208/50

[58] Field of Search ..... 208/127, 50

[56] References Cited

U.S. PATENT DOCUMENTS

| | | | |
|---|---|---|---|
| 2,879,221 | 7/1954 | Brown | 208/53 |
| 2,885,272 | 5/1959 | Kimbelin, Jr. et al. | 208/127 |
| 2,901,416 | 8/1959 | Tate | 208/127 |
| 3,671,424 | 6/1972 | Saxton | 208/127 |
| 3,816,084 | 6/1974 | Moser, Jr. et al. | 208/127 X |
| 4,269,696 | 5/1981 | Metrailer | 208/50 X |
| 4,295,956 | 11/1981 | Metrailer | 208/127 |
| 4,410,420 | 10/1983 | Liss et al. | 208/127 |

*Primary Examiner*—Glenn Caldarola

*Attorney, Agent, or Firm*—Henry E. Naylor

[57] ABSTRACT

A fluid coking process is provided in which a fresh carbonaceous feed is coked in a transfer line first coking zone positioned in a fluidized bed second coking zone. A heavy oil coker product is recycled to the fluidized bed second coking zone maintained at a lower temperature than the first coking zone. This process permits low severity coking of the fresh carbonceous feed and higher severity coking of the recycle oil, thereby minimizing conversion to coke and gas and increasing yield of normally liquid products.

12 Claims, 1 Drawing Sheet

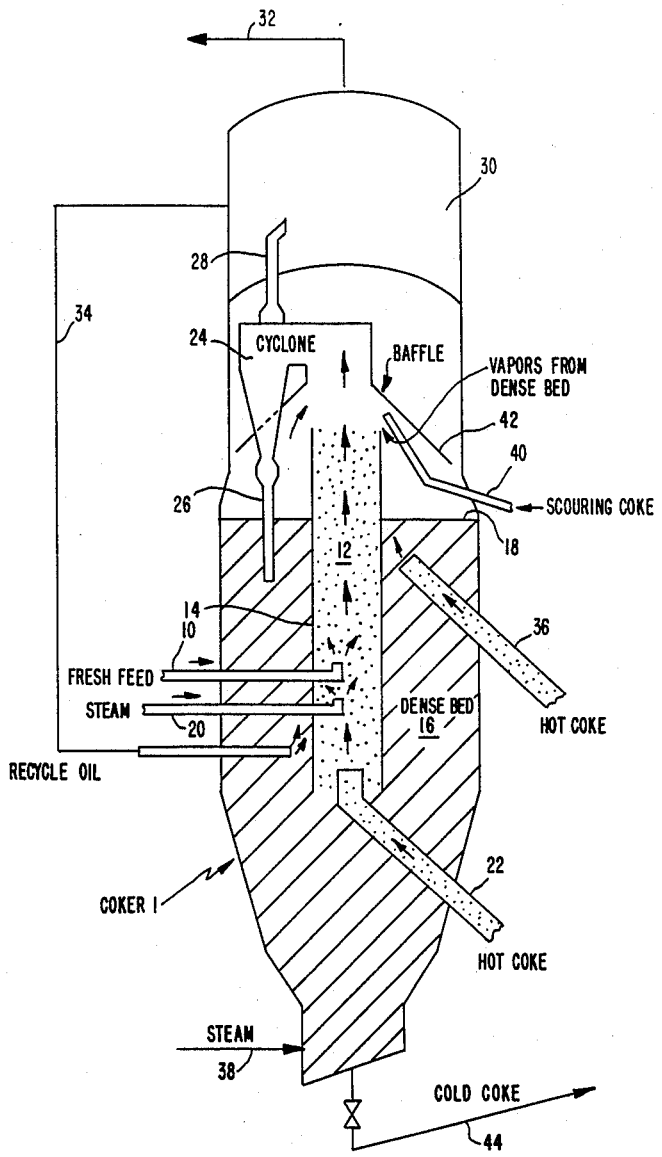
32
30
28
34
24
CYCLONE
BAFFLE
VAPORS FROM DENSE BED
42
40
SCOURING COKE
26
18
12
14
10
36
FRESH FEED
STEAM
20
DENSE BED
16
HOT COKE
RECYCLE OIL
22
COKER I
HOT COKE
STEAM
38
COLD COKE
44

LOW SEVERITY FLUID COKING

CROSS-REFERENCE TO RELATED APPLICATIONS

This application is a continuation-in-part of U.S. Ser. No. 866,744, filed May 27, 1986, now abandoned, which is a continuation-in-part of U.S. Ser. No. 763,208 filed Aug. 7, 1985, abandoned, which is a continuation-in-part of U.S. Ser. No. 619,542 filed June 11, 1984, abandoned, the teachings of both of which are hereby incorporated by reference.

BACKGROUND OF THE INVENTION

1. Field of the Invention

This invention relates to an improvement in a fluid coking process.

2. Description of the Prior Art

Fluid coking is a well-know process which may be carried out with or without recycle of the heavier portion of the fluid coking zone effluent. As is well known in the art, the fluid coking process, as shown, for example, in U.S. Pat. No. 2,881,130, which is hereby incorporated by reference, uses a fluid coking vessel and an external heating vessel. A fluid bed of solids, preferably coke particles produced by the process, having a size in the range from about 40 to about 1000 microns, is maintained in the coking zone by the upward passage of fluidizing gas, usually steam, injected at a superficial velocity, typically between 0.3 and 5 feet per second. The temperature in the fluid coking bed is maintained in the range of about 850° to 1400° F., preferably between 900° and 1200° F. by circulating solids (coke) to the heating vessel and back. The heavy oil to be converted is injected into the fluid bed and upon contact with the hot solids undergoes pyrolysis evolving lighter hydrocarbon products in the vapor phase, including normally liquid hydrocarbons, and depositing a carbonaceous residue (coke) on the solids. The turbulence of the fluid bed normally results in substantially isothermal reaction conditions and thorough and rapid distribution of the heavy injected oil. Product vapors, after removal of entrained solids, are withdrawn overhead from the coking zone and sent to a scrubber and fractionator for cooling and separation. The end boiling point of distillate fractions obtained from the process is usually about 900° F. to about 1050° F. and the remaining heavy ends are typically recycled to extinction.

U.S. Pat. No. 4,426,277 discloses a fluid coking process in which the feed is first passed into a dense phase zone and then into a transfer line zone. A third coking zone is operated at a higher temperature than the first two zones.

U.S. Pat. No. 2,879,221 discloses a two-stage coking process in which the second stage is operated at a higher temperature than the first stage.

U.S. Pat. No. 2,853,434 discloses a two-stage coking process in a unitary vessel. Each stage contains a fluidized bed.

An improved low severity fluid coking process has now been found in which coke and gas yields may be decreased relative to conventional fluid coking while increasing the yield of liquid products.

SUMMARY OF THE INVENTION

In accordance with the invention, there is provided a fluid coking process which comprises the steps of: (a) introducing a fresh carbonaceous feed into a transfer line first coking zone maintained at a temperature ranging from about 900° to about 1200° F. to contact a suspension of hot solids and to form coke which deposits on said solids and a first vapor phase product, including light and heavy hydrocarbons, at least a portion of said first coking zone being positioned within a second coking zone containing a fluidized bed of solids, said second coking zone being maintained at a temperature at least 20° F. lower than said first coking zone and at a temperature ranging from about 850° to about 1000° F.; (b) reacting said fresh carbonaceous feed with said suspension in said first coking zone for a residence time ranging from about 0.2 to 7 seconds; (c) separating at least a portion of said solids from said suspension; (d) passing the resulting separated solids to said fluidized bed second coking zone; (e) separating at least a portion of said heavy hydrocarbons from said vapor phase first coking zone product of step (a) in a separation zone; (f) introducing at least a portion of said separated heavy hydrocarbons of said first coking zone vapor product into said fluidized bed second coking zone for a residence time ranging from about 10 to 50 seconds, to form coke, which deposits on the solids of said fluidized bed second coking zone, and a second vapor phase product, including normally liquid hydrocarbons, and (g) removing a vapor phase product from said separation zone of step (e), said removed vapor phase product comprising a portion of said first coking zone vapor product and a portion of said second coking zone vapor product.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a fresh carbonaceous feed is introduced by line 10 into a first coking zone 12. The first coking zone 12 comprises a draft tube 14 which serves as a transfer line. The lower open end of draft tube 14 is positioned within a dense fluidized bed of solids (e.g., coke of 40 to 1000 microns) 16, which is a second coking zone, having an upper level indicated at 18. Above fluidized bed 16 is a dilute phase. Fluidized bed 16 is located in coker 1. Suitable fresh carbonaceous feeds for introduction into first coking zone 12 include heavy hydrocarbonaceous oils; heavy and reduced petroleum crude oils; vacuum residua; atmospheric residua; pitch, asphalt, bitumen; other hydrocarbon residues; tarsand oil; shale oil; coal; coal slurries; liquid products derived from coal liquefaction processes, including coal liquefaction bottoms, and mixtures thereof. By "fresh feed" is intended herein that the feed is not a recycle stream of the process. Preferably, the fresh feed is a hydrocarbonaceous oil. Typically, such feeds have a Conradson carbon residue of at least about 5 weight percent, generally about 5 to about 50 weight percent, preferably above 7 weight percent (as to Conradson carbon residue, see ASTM Test D189-65). A fluidizing gas (i.e., transport gas) is introduced by line 20 into draft tube 14 in an amount sufficient to suspend hot solid particles (coke) that are introduced into the lower open end of draft tube 14 by line 22. The resulting suspension passes through draft tube 14 at a velocity ranging from about 25 to about 100 feet per second, preferably at a velocity ranging from about 35 to about 60 feet per second. The transfer line first coking zone (within draft tube 14) is maintained at a temperature ranging from about 900° to about 1200° F., preferably from about 950° to about 1100° F., more preferably from about 1000° to about 1100° F., and a total pressure ranging from about 5 to about 150 psig, preferably from about 5 to about 35 psig. The fresh feed contacts the suspension in coking zone 12 and reacts with the suspension for a residence time ranging from about 0.2 to about 7 seconds, preferably from about 0.2 to about 5 seconds, more preferably from about 0.5 to about 2 seconds. The fluidizing gas of line 20 may comprise steam, normally gaseous hydrocarbons, vaporized normally liquid hydrocarbons, hydrogen, hydrogen sulfide and mixtures thereof. Typically, the fluidizing gas will comprise steam. Contact of the fresh feed with the hot solids in the suspension produces a solid carbonaceous residue which deposits on the solids and a vapor phase product, including light and heavy hydrocarbons. Since draft tube 14 is positioned, in part, within the hot bed of fluidized solids, coke deposition on the inner wall of the draft tube is minimized. The suspension flows out of the open upper end of draft tube 14 whereby a major portion of the solids is separated from the vapor phase product by gravity. The vapor phase product of the first coking zone, which may still contain a small amount of solids, passes into a gas-solid separation zone, such as cyclone 24 positioned in coker 1 above fluidized bed 16. The separated solids are passed into fluidized bed 16 by dipleg 26. The separated vapor phase product of the first coking zone flows via line 28 into scrubbing zone 30 mounted on the coker. In scrubbing zone 30, the heavy hydrocarbons of the vapor phase product are condensed. The remaining vapor phase product, including normally liquid hydrocarbons, is removed from scrubbing zone 30 by line 32 for fractionation in a conventional way. The condensed heavy hydrocarbons, hereafter designated "the recycle stream", is removed from scrubbing zone 30 and passed by line 34 into the dense fluidized bed second coking zone 16. The fluidized bed second coking zone 16 is maintained at a temperature ranging from about 850° F. to about 1000° F., preferably from about 850° to about 975° F., more preferably from about 900° to 975° F., by hot solids introduced by line 36 and at a pressure ranging from about 0 to about 150 psig, preferably from about 5 to about 45 psig. The temperature of this second coking zone is maintained at a temperature which is at least 20° F., preferably at least 50° F., and more preferably at least 75° F., lower than the first coking zone. Furthermore, in this second coking zone, the residence time of the recycle stream is from about 10 to 50 seconds, preferably about 15 to 40 seconds, and more preferably about 20 to 40 seconds. The solids are maintained fluidized by introduction of a fluidizing gas via line 38. The fluidizing gas may be selected from the same group of gases as defined for the gas introduced into draft tube 14 by line 20. Typically, the fluidizing gas will comprise steam introduced in an amount and at a velocity sufficient to maintain the solids as a fluidized bed. Contact of the recycle hydrocarbonaceous oil stream with the hot particles in the fluidized bed forms coke which deposits on the fluidized solids and a vapor phase second coking zone product which includes normally liquid hydrocarbons. The vapor phase second coking zone product, which may comprise a small amount of entrained solids, flows into the dilute phase above the fluidized bed and enters cyclone 24 to be separated with the vapor phase product of the first coking zone. A stream of hot solids may be passed by line 40 into a dilute phase above bed 16 near the exit of the suspension from draft tube 14 to act as scouring solids to prevent coke from depositing on the walls of the draft tube. Baffle 42 is positioned in the dilute phase to decrease vapor residence time and to prevent coke from depositing on the inner walls of the equipment. The hot solids of lines 22, 36 and 40 may be derived from a heating zone, which may be a coke burner, such as shown in U.S. Pat. No. 2,881,130, or a heat exchange zone or a gasification zone, such as shown in U.S. Pat. Nos. 3,816,084 and 4,055,484, the teachings of which are hereby incorporated by reference. A stream of cold solids is removed from the fluidized bed coking zone by line 44. The cold solids may be sent to a heating zone and the reheated solids may be returned as the hot solids to the coking zone.

While the solids have been described as being coke for simplicity of description, it is to be understood that the seed particles on which the coke that is being formed is deposited may be silica, alumina, zirconia, magnesia, calcium oxide, mullite, bauxite and the like. Furthermore, the solids may comprise a catalyst.

By providing a short contact time coking zone and a longer holding time lower temperature contact zone, the process of the present invention permits coking a fresh feed and a coker recycle stream at different conditions in separate zones to minimize coke yield and maximize liquid products. The differences in coking a recycle stream and a fresh stream at constant temperature are shown in Table I.

TABLE I

EFFECT OF FEED TYPE ON COKE AND OTHER YIELDS

| Run No. | 1 | 2 | 3 | 4 |
|---|---|---|---|---|
| Feed | Vac. Resid. 950° F. + Recycle Bottoms(1) | | Vac. Resid.(2) | |
| Run Conditions | | | | |
| Temperature, °F. | 962 | 963 | 963 | 962 |
| Pressure, psig | 12.3 | 14.1 | 12.0 | 12.3 |
| Inject steam, wt. % | 11.2 | 11.4 | 10.4 | 10.8 |
| Severity @ 950° F., sec.(3) | 30.8 | 34.8 | 32.8 | 36.4 |
| Ultimate Yields, wt. % | | | | |
| $C_3$-Gas | 14.83 | 15.48 | 12.11 | 10.69 |
| $C_4$ | 3.18 | 3.00 | 3.03 | 2.97 |
| $C_5$-430° F. | 13.73 | 11.74 | 19.62 | 19.34 |
| 430-650° F. | 8.68 | 7.34 | 12.71 | 13.24 |
| 650°-Cut Point | 24.09 | 18.63 | 23.42 | 24.42 |
| Coke | 35.49 | 43.80 | 29.14 | 29.36 |

(1)0.4° API, 3.6 wt. % S and 21.7 wt. % Conradson carbon.
(2)6.7° API, 2.8 wt. % S and 21.7 wt. % Conradson carbon.
(3)Synonymous with total vapor holding time.

As shown in Table I, a recycle stream yields more coke and gas when coked at constant conditions. By coking the fresh feed in a short contact transfer line reactor at high temperature, recracking and coke yield are minimized. The effect of vapor holding time (by means of changes in steam injection) is shown in Table II.

TABLE II

EFFECT OF VAPOR PHASE HOLDING TIME(1)/ SEVERITY ON COKE AND OTHER YIELDS

| Run No. | 5 | 6 |
|---|---|---|
| Feed | Heavy Vac. Resid.(2) | |
| Run Conditions | | |
| Temperature, °F. | 950 | 951 |
| Pressure, psig | 10.4 | 10.1 |
| Inject Steam, wt. % | 14.1 | 30.5 |
| Severity @ 950° F., sec(3) | 19.7 | 14.4 |

TABLE II-continued

| EFFECT OF VAPOR PHASE HOLDING TIME[1]/ SEVERITY ON COKE AND OTHER YIELDS | | |
|---|---|---|
| Run No. | 5 | 6 |
| Ultimate Yields, wt. % | | |
| $C_3$-Gas | 9.66 | 8.40 |
| $C_4$ | 2.28 | 2.08 |
| $C_5$-430° F. | 18.25 | 16.68 |
| 430-650° F. | 14.40 | 12.95 |
| 650-Cut Point | 28.38 | 35.57 |
| Coke | 27.06 | 24.35 |

[1]Via steam injection.
[2]7.8° API, 5.1 wt. % S and 21.5 wt. % Conradson carbon.
[3]Synonymous with total vapor holding time.

Table II shows that at constant temperature, if holding time (residence time) is increased 37% (14.4 to 19.7 sec.) coke make increases by 11%. Therefore, the effect of holding time on coke make is 0.3% coke per % holding time.

The effect of temperature on coke yield is shown in Table III.

TABLE III

| EFFECT OF TEMPERATURE ON COKE AND OTHER YIELDS | | |
|---|---|---|
| Run No. | 7 | 8 |
| Feed | Heavy Vac. Resid.[1] | |
| Run Conditions | | |
| Temperature, °F. | 951 | 1022 |
| Pressure, psig | 10.1 | 13.3 |
| Inject steam, wt. % | 30.5 | 29.3 |
| Severity @ 950° F., sec[2] | 14.4 | 27.2 |
| Ultimate Yields, wt. % | | |
| $C_3$-Gas | 8.40 | 7.88 |
| $C_4$ | 2.08 | 1.81 |
| $C_5$-430° F. | 16.68 | 15.28 |
| 430-650° F. | 12.95 | 13.54 |
| 650-Cut Point | 33.57 | 34.70 |
| Coke | 24.35 | 26.81 |

[1]7.8° API, 5.1 wt. % S and 21.5 wt. % Conradson carbon.
[2]Synonymous with total vapor holding time.

Table III shows that if temperature is increased by 7.5% (951° to 1022° F.) coke make increases by 6%. Therefore, the effect of temperature on coke make is 0.8% coke per % temperature increase.

From the data of Tables II and III it is evident that the effect of coke make to equivalent changes in holding time and temperature are quite different. That is, a given percent change in temperature produces 2 to 3 times more coke than an equivalent percentage changes in holding time.

What is claimed is:

1. A fluid coking process which comprises the steps of:

(a) introducing a fresh carbonaceous feed into a transfer line first coking zone maintained at a temperature ranging from about 900° to about 1200° F. to contact a suspension of hot solids and to form coke which deposits on said solids and a first vapor phase product, including light and heavy hydrocarbons, at least a portion of said first coking zone being positioned within a second coking zone containing a fluidized bed of solids, said second coking zone being maintained at a temperature at least 20° F. lower than said first coking zone and at a temperature ranging from about 850° to about 1000° F.;

(b) reacting said fresh carbonaceous feed with said suspension in said first coking zone for a residence time ranging from about 0.2 to 7 seconds.

(c) separating at least a portion of said solids from said suspension;

(d) passing the resulting separated solids to said fluidized bed second coking zone;

(e) separating at least a portion of said heavy hydrocarbons from said vapor phase first coking zone product of step (a) in a separation zone;

(f) introducing at least a portion of said separated heavy hydrocarbons of said first coking zone vapor product into said fluidized bed second coking zone for a residence time ranging from about 10 to 50 seconds to form coke, which deposits on the solids of said fluidized bed second coking zone, and a second vapor phase product, including normally liquid hydrocarbons, and (g) removing a vapor phase product from said separation zone of step (e), said removed vapor phase product comprising a portion of said first coking zone vapor product and a portion of said second coking zone vapor product.

2. The process of claim 1 wherein the residence time for the first coking zone ranges from about 0.2 to about 5 seconds.

3. The process of claim 1 wherein said first coking zone and said second coking zone are maintained at a pressure ranging from about 5 to about 150 psig.

4. The process of claim 1 wherein said first coking zone is maintained at a temperature ranging from about 950° to about 1100° F. and a pressure ranging from about 5 to about 35 psig.

5. The process of claim 1 wherein said first coking zone is maintained at a temperature ranging from about 1000° to about 1100° F.

6. The process of claim 1 wherein said second coking zone is maintained at a temperature of at least 50° F. lower than the first coking zone.

7. The process of claim 1 wherein said second coking zone is maintained at a temperature of at least 75° F. lower than the first coking zone.

8. The process of claim 1 wherein said fluidized bed second coking zone is maintained at a temperature ranging from about 850° to about 975° F. and a pressure ranging from about 5 to about 45 psig.

9. The process of claim 8 wherein said fluidized bed second coking zone is maintained at a temperature from about 900° to 975° F. and has a residence time of about 15 to 40 seconds.

10. The process of claim 1 wherein a fluidizing gas is introduced into said first coking zone and wherein a fluidizing gas is introduced into said second coking zone.

11. The process of claim 1 wherein hot solids are introduced into a dilute phase above said fluidized bed of solids and into said first coking zone.

12. The process of claim 1 wherein hot solids are introduced into said second coking zone and a stream of colder solids is removed from said second coking zone.

* * * * *